United States Patent [19]

Bobinger et al.

[11] Patent Number: 4,807,781

[45] Date of Patent: Feb. 28, 1989

[54] CONTAINER AND DISPENSING-CLOSURE ASSEMBLY

[75] Inventors: Karl J. Bobinger, Union Grove; Ronald R. Gutkowski, Racine, both of Wis.

[73] Assignee: S.C. Johnson & Son, Inc., Racine, Wis.

[21] Appl. No.: 73,137

[22] Filed: Jul. 14, 1987

[51] Int. Cl.[4] ..... B65D 37/00; B67D 3/00

[52] U.S. Cl. ..... 222/546; 215/237; 222/212; 222/556

[58] Field of Search ..... 222/531–537, 222/543, 545, 546, 547, 498, 559–563, 556, 212, 215; 215/235, 237; 220/335, 339

[56] References Cited

U.S. PATENT DOCUMENTS

| | | | |
|---|---|---|---|
| 1,797,869 | 3/1931 | Kennedy | 222/563 X |
| 1,804,760 | 5/1931 | Fox | 222/556 X |
| 2,439,985 | 4/1948 | Perelson | 222/545 |
| 2,878,976 | 3/1959 | Frederick | 222/498 |
| 3,265,256 | 8/1966 | Chaber et al. | 222/545 X |
| 3,302,835 | 2/1967 | Eckles | 222/531 |
| 3,303,971 | 2/1967 | Stevens, Jr. | 222/532 X |
| 3,393,844 | 7/1968 | Beres et al. | 222/533 |
| 3,502,248 | 3/1970 | Libit et al. | 222/534 |
| 3,516,581 | 6/1970 | Micallef | 222/529 |
| 3,659,756 | 5/1972 | Lancaster | 222/556 X |
| 3,718,238 | 2/1973 | Hazard et al. | 222/556 X |
| 4,087,028 | 5/1978 | Lang | 222/556 |
| 4,138,092 | 2/1979 | Apellaniz | 222/509 X |
| 4,371,095 | 2/1983 | Montgomery et al. | 215/235 X |
| 4,463,882 | 8/1984 | Hammett | 222/546 X |
| 4,600,130 | 7/1986 | Libit | 222/556 X |
| 4,632,266 | 12/1986 | Osswald | 222/534 X |
| 4,645,086 | 2/1987 | Rosenthal | 222/536 X |

*Primary Examiner*—Kevin P. Shaver

[57] ABSTRACT

A side dispensing-closure for a container wherein the dispensing-closure is made of a resilient plastic and includes a dispenser which is integral with a container cap for closing the container. The dispenser includes a recess in the top surface of the container cap for housing a dispensing orifice and a fluid passageway between the interior of the container and the dispensing orifice. A cover attached at one end of the recess encloses the dispenser orifice and fluid passageway and includes a plug extending from the underside of the top surface thereof which is mated with an opening in the passageway to open and close the passageway leading to the orifice when the cover is open or closed to provide a dispensing and non-dispensing position. The dispenser can be readily operated to dispense a material from the container while the cap is retained in place on the container.

10 Claims, 1 Drawing Sheet

CONTAINER AND DISPENSING-CLOSURE ASSEMBLY

This invention relates to a container and dispensing-closure assembly. More particularly, the invention relates to a dispensing-closure for a container wherein the dispensing-closure made of a resilient plastic includes a dispenser means which is integral with a cap for closing the container. The dispenser means can be readily opened and closed to dispense a material from the container while the container cap is retained in place on the container.

BACKGROUND AND PRIOR ART

Dispensing-closures for containers wherein the contents of a container can be discharged by opening a closure while the container cap is in place are known. These dispensing-closures are becoming increasingly attractive for the dispensing of various products such as relatively viscous products including hand creams, lotions, and the like. An essential feature of such dispensing-closures is that they can be readily opened and then tightly closed so as to be completely free from leakage around the opening. It is also necessary that the dispensing-closures are attractive to the consuming public and manufactured at a relatively low cost. Many designs for side dispensing closures do not form a complete seal when closed or have channels where product could leak when opened.

U.S. Pat. No. 2,439,985 discloses a dispensing closure having a body with a dispensing passageway therethrough and a hinged cover capable of manual operation to uncover or conceal the discharge end of the dispensing passageway. The portion of the body carrying the dispensing passageway has a lip for receiving the cover portion of the closure when the cover is in a closed position. The cover is attached by a pivot pin to the closure body which allows the cover to open and close in a shell-like manner. The friction present between the pivot pin and the cover is disclosed as allowing the hinged cover to be retained in any set position, i.e., either closed or open. The closure body has a recess located at the end of the cover which is away from the discharge end of the dispensing passageway so that, when the cover is raised to an open position, the back end of the cover can enter the recess and not prevent the upward movement of the cover.

U.S. Pat. No. 3,516,581 discloses a toggle type side dispensing closure. These closures have been commercialized for a number of years. While the closure forms a good seal in the closed position, there can be a problem with leakage in the open position. For instance, surfaces **37*b* and 22*b*** must cooperate to form a seal as the toggle of the cap is opened.

U.S. Pat. No. 4,087,028 discloses a one-piece plastic dispensing cap which can be affixed to a bottle by a snap fit, screw threads, or the like. The cap has a swingable closure section attached to the cap by a hinge. The swingable closure covers a dispensing orifice located in the top of the body of the cap. The closure has a serrated edge which allows the user to push the closure away from the cap body so that material can be dispensed through the dispensing orifice. The inner end sidewall of the closure contains a "button" (denoted as 19 in FIG. 2) which fits over the dispensing orifice when the closure is in a closed position to provide an air-tight and fluid-tight seal between the closure and cap body.

U.S. Pat. No. 1,804,760 discloses a dispensing closure for a container discharge spout. The closure surrounds the spout on its top, front, and sidewalls. The closure is connected to the spout by a pivot pin attached to the rear of the spout. On the end opposite the spout opening, the closure has a raised lip which can be engaged by the thumb of a user to raise the closure and uncover the spout opening.

U.S. Pat. No. 3,303,971 discloses a container with a pivoting spout. The pivoting spout is located in a recess in a container top and has a dispensing orifice therein. When the spout is pivoted upward, the dispensing orifice is exposed. The sidewalls of the dispensing spout are provided with projections along the lower edge which cooperate with triangularly shaped portions in the wall of the spout housing which limit the pivot motion of the dispensing spout. When pivoted to a certain position, the projection located on the spout engages the edge of the triangularly shaped portion of the housing wall so that movement of the dispensing spout beyond that position is prevented.

U.S. Pat. No. 2,878,976 discloses a cap for a tube dispenser. The cap contains a recessed portion having a dispensing orifice therein and a swinging closure member for enclosing the dispensing orifice. The swinging closure is retained in the recess by the snap engagement between bosses on the closure sidewalls and recesses in the cap recess sidewalls.

U.S. Pat. No. 3,265,256 discloses a swingable spout structure for attachment to a container. The spout swings on trunnions to move between dispensing and non-dispensing positions. The spout has a passageway therethrough which is in alignment or not with the container dispensing opening depending on the position of the spout. The spout has a ledge attached to its lower end which serves to lock the spout in the upward position when the spout is swung to an upward position. Additionally, the spout has two ribs projecting from either side which lock the spout in a non-dispensing position when the spout is lowered. The ribs are latched by protuberances in the spout base.

U.S. Pat. No. 3,718,238 discloses a safety dispensing closure in the form of a swingable spout. The spout has grooves extending along its sidewalls which coact with a detent means located on the closure body. When the detent means fit into the spout grooves, the spout is held in a closed position.

U.S Pat. No. 1,797,869 discloses a bottle having a metering chamber and a stopper plug. One face of the stopper plug is an inclined surface which serves as a passageway wall when the material to be dispensed enters the metering chamber. By rotating the stopper plug, the inclined face of the plug also acts as a passageway wall when material is thereafter dispensed from the metering chamber.

Accordingly, although the art of dispensing-closures discloses various types of dispensing-closures including side dispensing closures which are openable and closeable while the closure cap is retained in place on the container, all are limited by one or more objectionable or undesirable features. These objectionable and undesirable features include being relatively complex in construction and, accordingly, costly; have limited application particularly with respect to products which are not highly viscous; questionable attractiveness and acceptability to the consuming public; possibility of leakage in the dispensing position; and, additionally, the closures of the prior art have a tendency for product build-up around the opening when used with a viscous product, leading to an unsightly appearance.

OBJECTS AND GENERAL DESCRIPTION OF THE INVENTION

It is a primary object of the present invention to provide a container and a side dispensing-closure assembly for a container which permits the dispensing of a variety of products having varying consistencies contained in a container which is preferably resilient and which is simple in construction and in use.

It is another primary object of this invention to provide a side dispensing-closure for a container wherein the dispenser means of the dispensing-closure is an integral part of a container cap, with the dispenser means being readily opened and closed to dispense a material from the container while the container cap is in place on the container.

These and other objects of the invention will become apparent from the following general description of the invention and from the detailed description of the presently preferred embodiment.

The above primary and other objects of the invention are accomplished by providing a side dispensing-closure, preferably of injection molded plastic, in which dispenser means are integral with a container cap. More particularly, the dispenser means is part of a cap which is secured to the open-ended neck of a container by conventional means, such as a snap-fit means The cap has a recess in its top surface which can extend approximately the width of the neck of the container. Only one end of the recess, with that end being located at the area of the outer wall of the dispensing-closure, is open, the other end being closed. The recess is of a size to accommodate a passageway leading from the interior of the container to a dispensing orifice at the open-end of the recess, and the sidewalls of the cover means which encloses the passageway and dispensing orifice, and seals the passageway leading to the orifice. The passageway leading to the dispensing orifice extends upward from the area inside the container and, after reaching a level above the top of the container neck, turns at a substantially right angle to lead to the dispensing orifice. The cover is attached to the cap at the end of the cover located at the closed end of the recess by a living hinge. The cover means includes two downwardly projecting sidewalls which fit within the recess in the cap surrounding the dispensing orifice and passageway, and a front wall completely enclosing the dispensing orifice. The front wall of the cover which completely covers the orifice in the closed position preferably has a serrated edge or finger projection so that a user can easily raise the cover and swing the cover upward on the living hinge and expose the dispensing orifice. The upward movement of the cover is preferably limited by two projections, one on each sidewall of the cover, which coact with a projection protruding from each sidewall of the recess. Additionally, the cover has a plug projecting downward from the underside of the top surface thereof into the dispensing passageway leading up from inside the container of the cap at the point where the passageway turns at a substantially right angle to lead to the dispensing orifice. When the cover is in a closed position, the plug blocks the passageway leading to the dispensing orifice and, accordingly, stops any movement of material from the container to the dispensing orifice. Preferably the bottom surface of the plug is inclined so that when the cover is in a raised position (i.e., open) and the plug is located in the upper part of the passageway, the bottom surface of the plug will form a smooth curve in the passageway and allow the material being dispensed to smoothly move around the plug to the dispensing orifice. Further, the plug completely seals the orifice in the top of the dispensing channel while in the open position to prevent any leakage of product into the interior of the cap. Another preferred feature of the cover and plug arrangement is in providing a relief area at the point where the plug and top surface of the cover are joined. This relief area provides additional flexibility to the plug to permit the plug to enter the dispensing orifice without obstruction and to provide, when closed, a fluid-tight seal.

The container/dispensing-closure assembly of the present invention is of simple construction, attractive in appearance, and provides for the construction of a side dispensing-closure for dispensing products of varying consistency by simply opening the closure but yet the closure easily closes with a fluid-tight seal, avoiding loss of product by leakage or evaporation. The dispensing closure is easy for the ultimate consumer to use.

THE DRAWING AND DETAILED DESCRIPTION OF THE PRESENTLY PREFERRED EMBODIMENT

Having described the novel container and dispensing-closure assembly in general terms, a detailed description of the presently preferred embodiment will be described in relation to the drawing wherein FIG. 1 is a perspective view of the container and dispensing-closure assembly with the container partially broken away, with the dispensing-closure in place and in the open or dispensing position;

Figure 3:
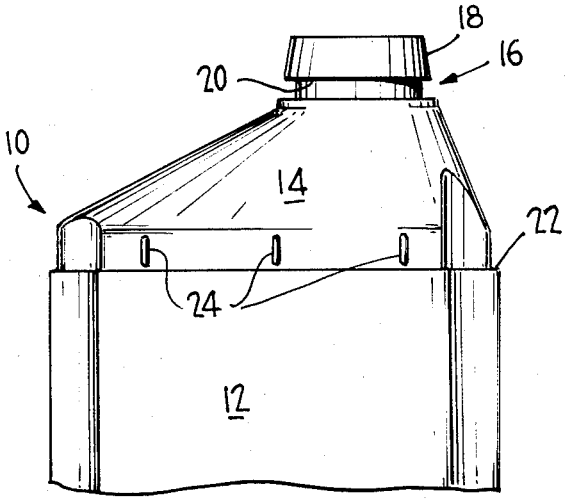
FIG. 3 is a side elevational view of the container of FIG. 1 with the dispensing-closure removed.
Figure 2:
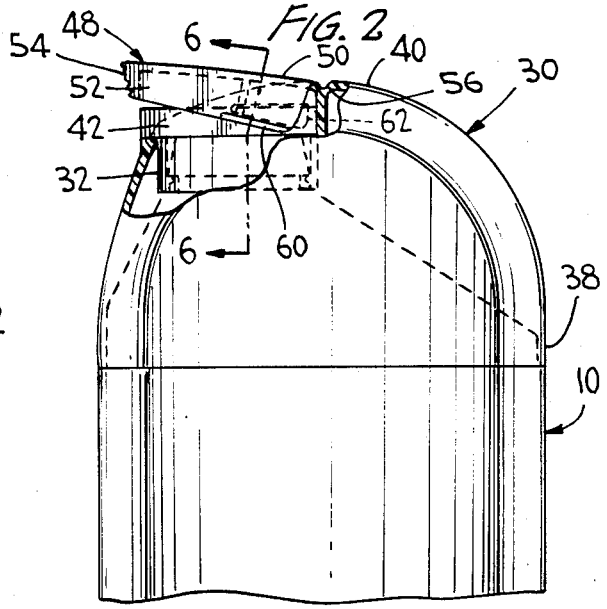
FIG. 2 is a side elevational view of the container and dispensing-closure of FIG. 1 partially broken away.
Figure 1:
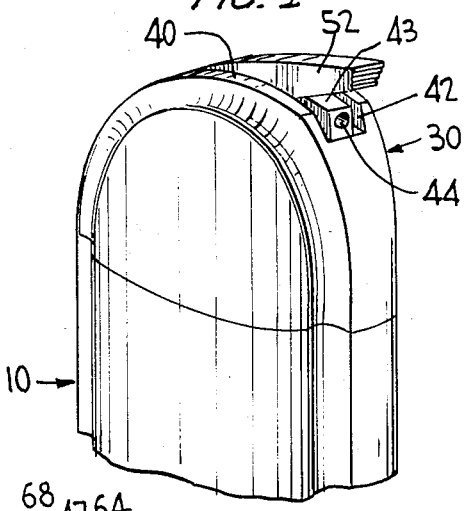
Figure 5:
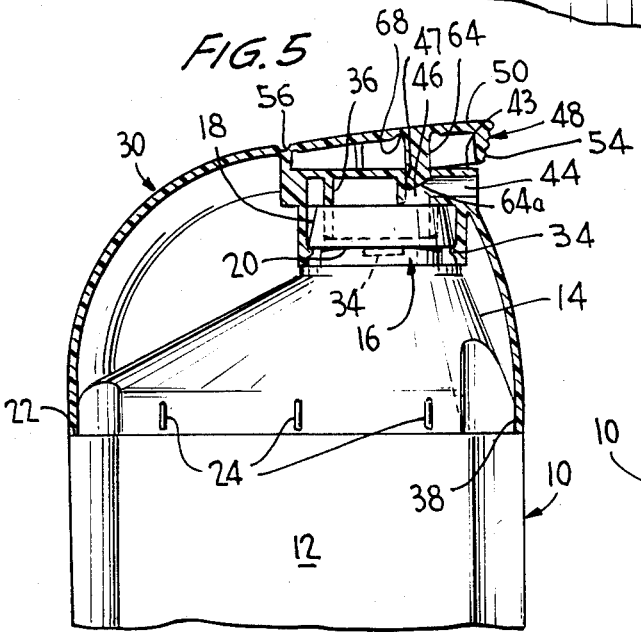
FIG. 5 is a view the same as the view of FIG. 4 of the container/dispensing-closure but in the open or dispensing position.
Figure 4:
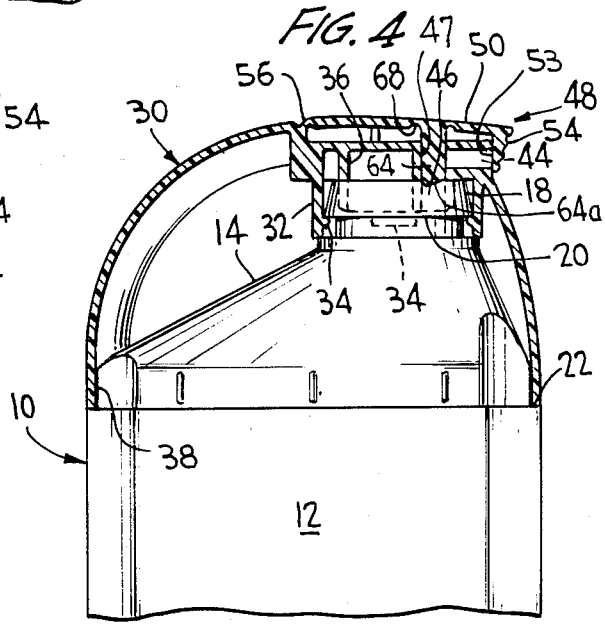
FIG. 4 is a side elevational view of the container/dispensing-closure assembly of FIG. 1 with the dispensing-closure being in section and in the closed or non-dispensing position.

Referring to the drawing, the container/dispensing-closure assembly is composed of a container 10 and a dispensing-closure 30. As best seen in FIGS. 3–5, container comprises sidewall portions 12, shoulder portions 14, and a neck 16. As best shown in FIG. 3, neck 16 which in the embodiment illustrated is offset to one side of the container includes an enlarged section 18 inwardly tapered in the upward direction to form an annular ring 20 at the lower edge of the tapered portion. The container, as best shown in FIGS. 3 and 5, has a slight recess 22 in the walls thereof starting near the shoulder portion extending upward and at the point of joinder of dispensing-closure 30 with container 10 so as to accommodate the thickness of the walls of the dispensing-closure without a protrusion. Also as shown in FIG. 3, the container substantially at the joinder of the sidewall and neck portion has three vertical ribs 24 which function to help position the dispensing-closure in place on the container as will be considered more fully hereinafter. The container is preferably made of a resilient material, such as injection molded plastic.

Figure 6:
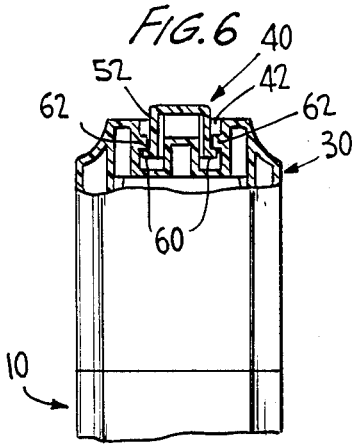
FIG. 6 is a sectional view of the container/dispensing-closure taken along line 6—6 of FIG. 2.

The dispensing-closure, as the term is used herein, designates the container cap and integral therewith dispenser means. As best seen in FIGS. 4, 5 and 6, the cap portion comprises an outer annular skirt 32 having discontinuous projection means 34 for engagement with annular ring 20 on the outer surface of neck 16 of container 10. An inner annular skirt 36 spaced inwardly from skirt 32 but of shorter length extends downwardly into section 18 of neck 16 with the two skirts together serving to position the dispensing-closure onto the container with a snap-fit action. The dispensing-closure further includes skirt 38 which extends downwardly from the uppermost surface of the dispensing-closure over shoulder portion 14 of container 10 to join with container sidewalls 12 at the beginning of recessed area 22. Skirt 38 is positioned on container 10 with the aid of vertical ribs 24 on container 10. Dispensing-closure 30 when positioned on container 10 completely seals the interior of the container to the outside. However, the container cap has a recess 42 in its top surface 40 which extends across and is substantially coextensive with the opening of neck 16. One end of the recess is open-ended. Because of neck 16 being offset, this open-end is positioned at one side of the container which, as will be seen, provides for more convenient dispensing of a product. The recess is of a size to accommodate a dispensing orifice 44 and a passageway 46 extending between the dispensing orifice 44 and the interior of the container, and a cover 48 having a top surface 50, downwardly extending sidewalls 52, and front wall 53.

The passageway 46 leading to the dispensing orifice 44 extends upwardly from the area inside the inner annular skirt 36 which is fitted to container neck 16. The passageway, after reaching a level above the top of annular skirt 36, turns at substantially a right angle and leads to the dispensing orifice 44. The cover 48, including sidewalls 52, fits entirely within the recess 42 so that the top of the cover is flush with the top surface of the dispensing-closure and surrounds the dispensing orifice and passageway when in the closed or non-dispensing position. The cover is attached to the closure at one end by a living hinge 56. The front wall 53 of the cover 48 preferably has a serrated edge or finger projection at 54 so that a user can raise the cover and swing the cover upwardly on hinge 56 and expose the dispensing orifice 44. The upward movement of the cover is limited by two projections 60, one on each sidewall of cover 48 which coact with a projection 62 protruding from each sidewall of the recess 42 as best seen in FIG. 6.

Additionally, cover 48 has a plug 64 projecting downwardly from the inside surface of cover 48 through opening 47 in the top exterior surface 43 of orifice 44 into dispensing passageway 46 leading up from inside the annular skirt 32 of the closure at the point where the passageway turns at a substantially right angle to lead to the dispensing orifice 44. When the cover is in the closed position, the plug blocks the passageway leading to the dispensing orifice and, accordingly, stops any movement of material from the container to the dispensing orifice. The bottom surface **64*a* of the plug 64 is preferably inclined so that when the cover is in the raised position, i.e., open, and the plug is located in the upper part of the passageway, the bottom surface of the plug will form a smooth curve in the passageway and allow the material being dispensed to smoothly move around the plug to the dispensing orifice 44. Furthermore, the diameters of plug 64 and opening 47 are sized such that there is a snug but sliding fit which seals opening 47 when the cover is in the raised or open position. Also the limitation on upward movement by the interaction of projections 60 and 62 and the length of plug 64 also ensure the sealing of opening 47. As best seen in FIGS. 4 and 5, there is preferably a relief area 68 extending all around plug 64 which provides additional flexibility of plug 64 so as to better enable a fluid-tight seal of the passageway 46 when the closure is in the closed or non-dispensing position. Lastly, the front wall 53 should be long enough to completely cover dispensing orifice 44 when the closure is in the closed position. Front wall 53 does not form a seal but does cover the orifice and prevents the user from observing dried product which may be retained in orifice 44** after dispensing.

As is apparent, the entire device which preferably is injection molded from plastic is of simple construction and attractive design. The device is conveniently operated by the ultimate consumer simply by pushing upwardly on the end of cover 54 so as to open the passageway. Material can then be dispensed from the container by tilting the container and squeezing on the resilient sides of the container. If the container is not resilient, in a less preferred embodiment the material will drip from the container by gravity. After the proper amount of material is dispensed, the passageway to the container can be sealed in a fluid-tight seal simply by pressing downwardly on cover 48. When the plug engages the seal, the material within the vertically extending part of the passageway 46 is forced back into the container and eliminates forcing material outward through orifice 44 on closure.

As will be apparent to one skilled in the art, various modifications can be made within the scope of the aforesaid description. For example only, it is not essential that the dispensing-closure have the downwardly extending skirts 38 or that neck 16 be offset as illustrated in the presently preferred embodiment. Such modifications being within the ability of one skilled in the art form a part of the present invention and are embraced by the appended claims.

It is claimed:

1. A dispensing-closure for a container comprising a cap portion including means for enclosing a container and means for attaching said dispensing-closure onto a container in fluid-tight sealing relation therewith, and dispenser means integral with said cap portion, said dispenser means including a recessed are in the top surface of said cap portion, said recess being open at one end and sized to receive a passageway and a dispensing orifice, said passageway connecting said dispensing orifice and the interior of a container and having an opening therein, and cover means having a top surface, sidewalls and a front wall enclosing said passageway, said cover means further including plug means extending downward from the underside of said top surface of said cover means and joined thereto, said cover means further including a relief area around said plug where said plug joins the underside of said top surface to permit said plug to tilt relative to said cover means when said cover means is moved to a position to open said passageway with said plug having a uniform diameter throughout its length and being constructed and arranged to mate with said opening in said passageway to provide a fluid-tight seal when said cover means is in a closed and non-dispensing position and to allow free fluid passage from the interior of a container to said orifice when in the open and dispensing position, said cover means having a living hinge connecting said cover means to said cap portion.

2. The dispensing-closure of claim 1 wherein the passageway extends upward from an are inside the container and, after reaching a level above the top of the container neck, turns at a substantially right angle to lead to the dispensing orifice.

3. The dispensing-closure of claim 1 wherein the cap portion is offset to fit over a neck leading to the interior of said container which neck is correspondingly offset from its center to permit sealing engagement with said cap portion and the cap portion further contains a downwardly extending skirt which fits over a sidewall present on the container to position the dispensing orifice in a specific orientation with respect to the container.

4. The dispensing-closure of claim 1 wherein the end of said plug away from the point where the plug joins said cover means is inclined.

5. The container/dispensing-closure of claim 4 wherein the sidewalls of said recess each include a first projecting means and said sidewalls of said cover means each include a second projecting means opposite and extending beneath the first, with said first projecting means co-acting with said second projecting means to limit the upward movement of said cover means.

6. A container/dispensing-closure assembly comprising a container having a neck with an opening into said container, a sidewall portion and a shoulder portion between and joining said neck and sidewall portion, and a dispensing-closure fitted to the neck of said container; said dispensing-closure comprising a cap portion including means for enclosing said opening of said neck of said container and means for attaching said dispensing-closure onto said neck of said container in fluid-tight sealing relation therewith, and dispenser means integral with said cap portion, said dispenser means including a recessed area in the top surface of said cap portion, said recess being open at one end and sized to receive a passageway and a dispensing orifice, said passageway connecting said dispensing orifice and the interior of said container and having an opening therein, and cover means having a top surface, sidewalls and a front wall enclosing said passageway, said cover means further including plug means extending downward from the underside of said top surface of said cover means and joined thereto, said cover means further including a relief area around said plug where said plug joins the underside of said top surface to permit said plug to tilt relative to said cover means when said cover means is moved to a position to open said passageway, with said plug having a uniform diameter throughout its length and being constructed and arranged to mate with said opening in said passageway to provide a fluid tight seal when said cover means is in a closed and non-dispensing position and to allow free fluid passage from the interior of said container to said orifice when in the open and dispensing position, said cover means having a living hinge connecting said cover means to said cap portion.

7. The dispensing-closure of claim 6 wherein the passageway extends upward from an area inside the container and, after reaching a level above the top of the container neck, turns at a substantially right angle to lead to the dispensing orifice.

8. The dispensing-closure of claim 6 wherein the neck of said container is offset to one side of the container and the cap portion is correspondingly offset and further contains a downwardly extending skirt which fits over the sidewall of the container to position the dispensing orifice in a specific orientation with respect to the container.

9. The container/dispensing-closure of claim 6 wherein the end of said plug away from the point where the plug joins said cover means is inclined.

10. The container/dispensing-closure of claim 9 wherein the sidewalls of said recess each include a first projecting means and said sidewalls of said cover means each include a second projecting means opposite and extending beneath the first, with said first projecting means co-acting with said second projecting means to limit the upward movement of said cover means.

* * * * *